United States Patent [19]

Ben-Dov

[11] 3,932,876

[45] Jan. 13, 1976

[54] SHORT END-FIRE CIRCULARLY POLARIZED ANTENNA

[75] Inventor: Oded Ben-Dov, Medford, N.J.

[73] Assignee: RCA Corporation, New York, N.Y.

[22] Filed: Aug. 9, 1974

[21] Appl. No.: 496,361

[52] U.S. Cl. ..... 343/895; 343/912

[51] Int. Cl.[2] ..... H01Q 1/36

[58] Field of Search ..... 343/895, 899, 843, 848, 343/867, 830, 846, 912

[56] References Cited

UNITED STATES PATENTS

| | | | |
|---|---|---|---|
| 2,503,010 | 4/1950 | Tiley | 343/895 |
| 2,919,442 | 12/1959 | Nussbaum | 343/895 |
| 3,573,840 | 4/1971 | Gouillou et al. | 343/895 |
| 3,757,345 | 9/1973 | Carver | 343/895 X |
| 3,852,756 | 12/1974 | Reese | 343/895 X |

*Primary Examiner*—James W. Lawrence
*Assistant Examiner*—E. R. LaRoche
*Attorney, Agent, or Firm*—Edward J. Norton; Robert L. Troike

[57] ABSTRACT

A circularly polarized antenna having an end fed short length helical conductor within a conductive funnel-shaped reflector is described. A broad beam width and a relatively low axial ratio is achieved by the termination of the short length helical conductor about a conductive disk and by providing a reflector of shallow depth.

9 Claims, 5 Drawing Figures

SHORT END-FIRE CIRCULARLY POLARIZED ANTENNA

BACKGROUND OF THE INVENTION

This invention relates to circularly polarized helix antennas and more particularly to an antenna system for producing a substantially broad beam width unidirectional radiation pattern or an omnidirectional radiation pattern in the horizontal plane using only three such helix antennas mounted to a triangular mast or tower.

In radio or television broadcasting, it is particularly desirable in many installations to broadcast an omnidirectional pattern so that all receivers at a given radial distance from the broadcaster's antenna receive essentially the same signal strength. Often the broadcasting antennas are mounted or are required to be mounted to a triangular tower which may serve as the support for other antennas. It is therefore desirable for the sake of cost to provide antennas which have a beam width and a structure such that when one is mounted to each side of a triangular tower essentially omnidirectional radiation takes place. When there is a requirement for the provision of circularly polarized radiation, additional problems are encountered in mounting the antennas to the reflective towers.

The use of a helical antenna to provide circularly polarized radiation is known in the state of the art. It is also known in the art to reduce backlobes by placing a helix forward of a ground reflector or within a conical or funnel-shaped reflector. It is known in the art that a helix within a funnel-shaped reflector produces a beam which is approximately the same beam width in all planes and in all polarizations. The phase center of a helix in a funnel-shaped reflector is located on the helix axis approximately in the plane of the aperture of the reflector. In order to produce a broad beam width pattern especially broad enough so that three about a tower produce an omnidirectional pattern, it is desirable to place the entire helix within the conical or funnel-shaped reflector and to shorten the helix and to shorten the reflector. It is known in the literature that a short helix on the order of a few wavelengths (two for example) without some form of end-loading cannot produce circularly polarized radiation. See "Some Aspects of the Design and Use of the Helical Antenna" by G. Svennerus, Proc. of International Congress, Ultra High Frequency Circuits, Paris, France, Oct. 21–26, 1957, Vol. 2. This is because the open end reflection causes a secondary circularly polarized wave to be radiated with a sense of rotation opposite to the primary radiated wave. However, there is no teaching in the prior art of an efficient end loading structure that permits a broad beam width pattern with a reasonably low axial ratio.

BRIEF DESCRIPTION OF INVENTION

Briefly, an improved end-fire helical antenna of the type which produces a broad beam width pattern with low sidelobes and a low axial ratio is provided by a short helix in a funnel-shaped reflector. One end of the helix is connected to a feed line near the reflector base with the opposite end terminating in the plane of the aperture of the reflector and connected to an end load, where the end load is a flat conductive plate supported by a metal rod to the reflector.

DETAILED DESCRIPTION OF INVENTION

A more detailed description of the invention follows in conjunction with the following drawings wherein.

Figure 1:
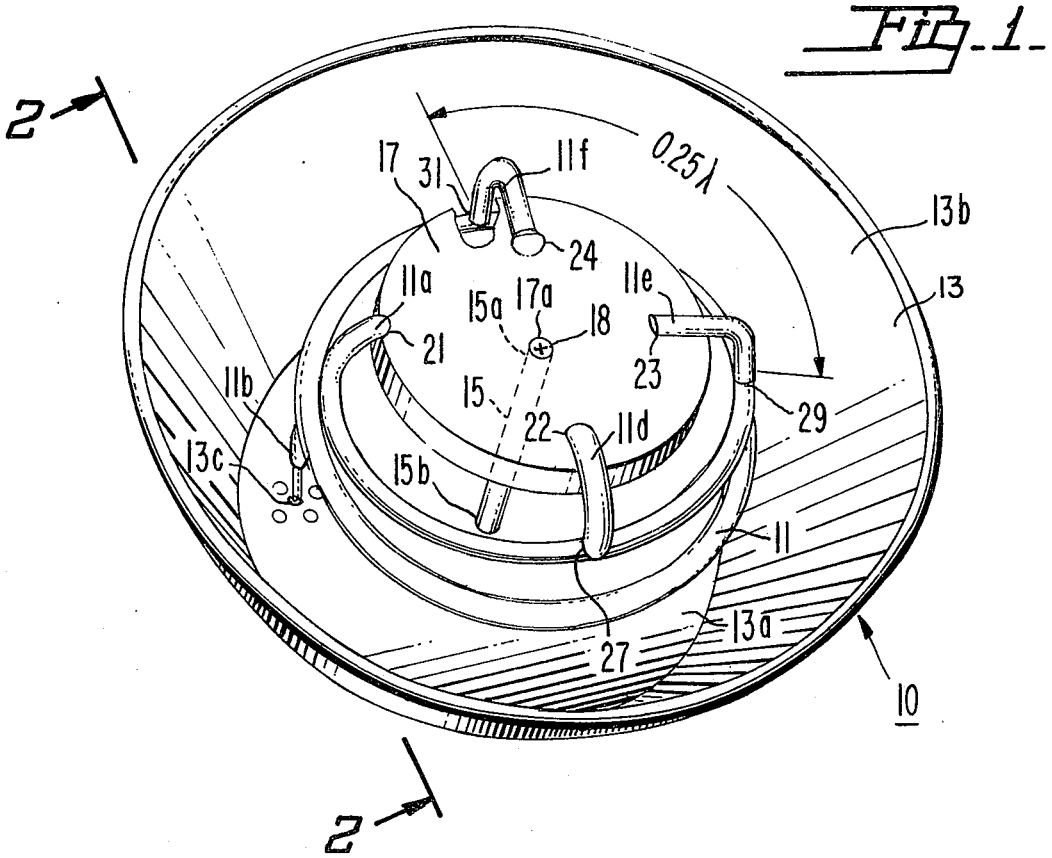
FIG. 1 is a perspective view of an antenna according to one embodiment of the present invention.
Figure 2:
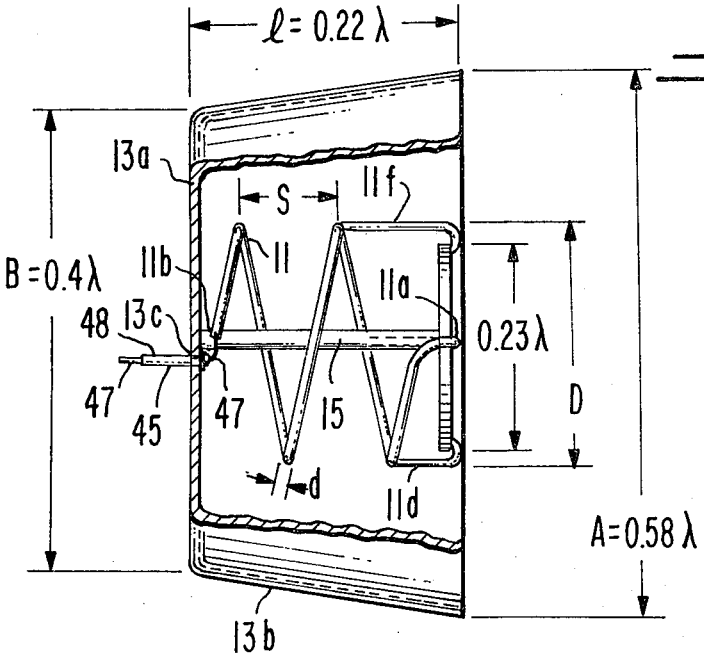
FIG. 2 is a cross sectional view of FIG. 1 taken along line 2—2 of FIG. 1.

Referring to FIGS. 1 and 2, a helical antenna 10 includes a helical coil 11 mounted within funnel-shaped reflector 13 by means of a post 15 and a conductive disk 17. The disk 17 has an aperture **17*a* in the center thereof and the post 15 has a threaded hole at the end 15*a*. A metal bolt 18 with a flat head is adapted to fit into the threaded hole of the post 15 and to hold the disk 17 to the post 15. The opposite end 15*b* of the post 15 is mounted to the base 13*a* of reflector 13 by similar arrangement, not shown. This mounting of the post 15 to the base 13*a* or to disk 17** may also be accomplished by welding or by any other well known means for fixing one metal part to another.

The coil 11 is mounted to disk 17 at end **11*a*. The coil 11 has a total length to its feed terminal end 11*b* near the base 13*a* equal to two wavelengths. All wavelengths as used herein refer to the center operating frequency of the antenna. The coil 11 is connected to disk 17 at points 21, 22, 23 and 24 on disk 17. The point 21 on disk 17 is connected to the end 11*a*. Point 22 on disk 17 is located approximately one quarter of the length of the circumference of the disk 17 from point 21. Point 23 is located on disk 17 approximately one quarter of the length of the circumference of the disk 17 from point 22. Point 24 is located on disk 17 approximately one quarter of the length of the circumference of disk 17 from point 23. The diameter D of the helical coil 11 is larger than that of the disk 17 and equals approximately $\lambda/\pi$. A conductive arm 11*d* connects point 22 on disk 17 to a point 27 on coil 11 approximately 0.25 wavelengths from the end 11*a*. A conductive arm 11e connects point 23 on disk 17 to a point 29 on coil 11. Point 29 is located approximately 0.25 wavelengths from point 27 on coil 11. Conductive arm 11*f* connects point 24 on disk 17 to point 31 on coil 11. Point 31 is located approximately 0.25 wavelengths from point 29 on coil 11. The coil 11 continues for another wavelength and a quarter ($5/4\lambda$) with the same diameter D ($\lambda/\pi$) of the coil to end 11*b***. The coil has a pitch angle equal to about 8°. The axial length $l$ of the coil is about $0.22\lambda$. The diameter d of the coil itself is about 0.03 wavelengths. The length of one turn is equal to $\lambda$ or one wavelength.

The funnel-shaped reflector 13 includes the flat base **13*a* with tapering sides 13*b* to the aperture at the open end thereof which is flush with the disk 17. The base 13*a* is all of conductive material except for a small aperture 13*c* through which is passed the center conductor 47 of a coaxial feed line conductor 45. The center conductor 47 passes through aperture 13*c* and connects to coil 11 at end 11*b*. The outer conductor 48 is connected to the conductive base 13*a*. The coil 11 is fed near the periphery of the base in this arrangement as shown in FIG. 1 and hence this is referred to as a periphery fed end-fire helix. A center fed helix may also be used wherein the coil 11 is connected to the feed at approximately the center of the base 13***a*. The funnel-shaped reflector 13 has a base diameter of 0.4 wavelengths and tapers linearly over a length 0.22 wavelengths to the aperture in the axial direction from the base, which aperture is 0.58 wavelengths in diameter.

In the operation of the antenna described above, the first wavelength section of the coil acts as a standard helical resonator and the second wavelength section acts as a special termination. This special termination is provided at the disk 17 which is fed in phase rotation about its circumference with the points 21, 22, 23 and 24 being the 0°, 90°, 180° 270° relative phase points of this disk radiator. This special termination both minimizes open end reflections (which destroy the low axial ratio) but also aids in the radiating performance of the antenna.

Figure 3:
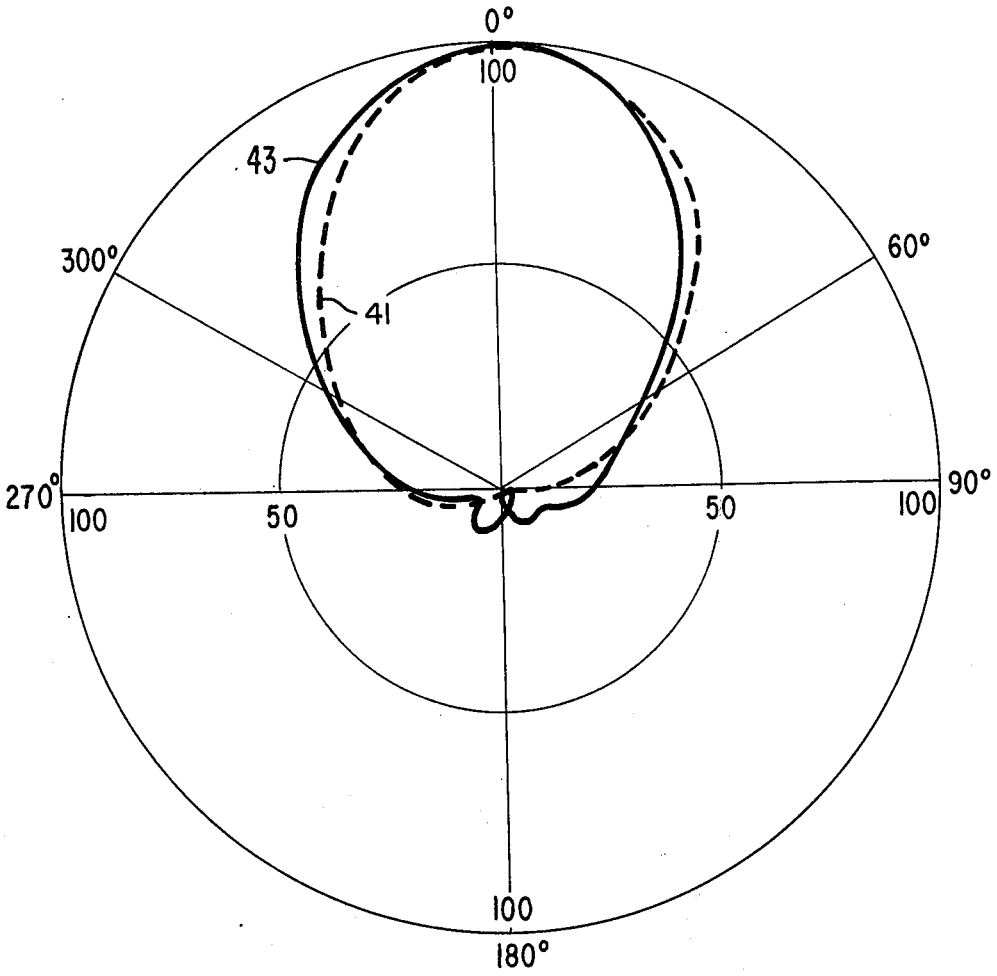
FIG. 3 is a horizontal pattern of a single short helix antenna as shown in FIG. 1.

In the arrangement as described above and operating at a center frequency of 720 MHz a horizontal pattern was produced as shown in FIG. 3. The horizontal polarization is illustrated in dashed lines 41 and the vertical polarization is illustrated in solid lines 43. It can be seen that these closely approximate each other and the relative phase between the two polarizataions is 90°. Also as can be seen by observing the pattern at the half power points, the beam width nearly approaches 120°. The dimension of this antenna are aperture A = 9 1/2 inches, base 13*a* = 6.5 inches, axial length $l$ = 3.6 inches, disc diameter = 3.7 inches, disc thickness = ⅛ inch, wavelength $\lambda$ = 16.4 inches, diameter $d$ of coil = ⅝ inch, diameter D of coil = 5 inches, coil length = 32.8 inches, pitch angle of coil = 8°. The coil is terminated every 4.1 inches to disk 17 for the last 12.3 inches of the coil 11.

Figure 4:
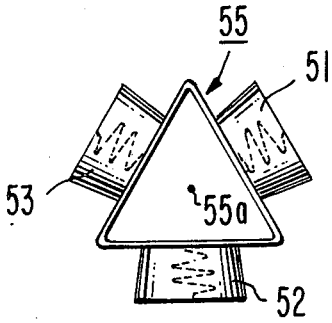
FIG. 4 illustrates three of the helix antennas shown in FIG. 1 mounted on a triangular tower.

FIG. 4 illustrates a top plan view of three such antennas 51, 52 and 53 as shown in FIGS. 1 and 2 mounted on a triangular tower 55 with the axis of the coils firing radially from the center 55*a* of tower 55.

Figure 5:
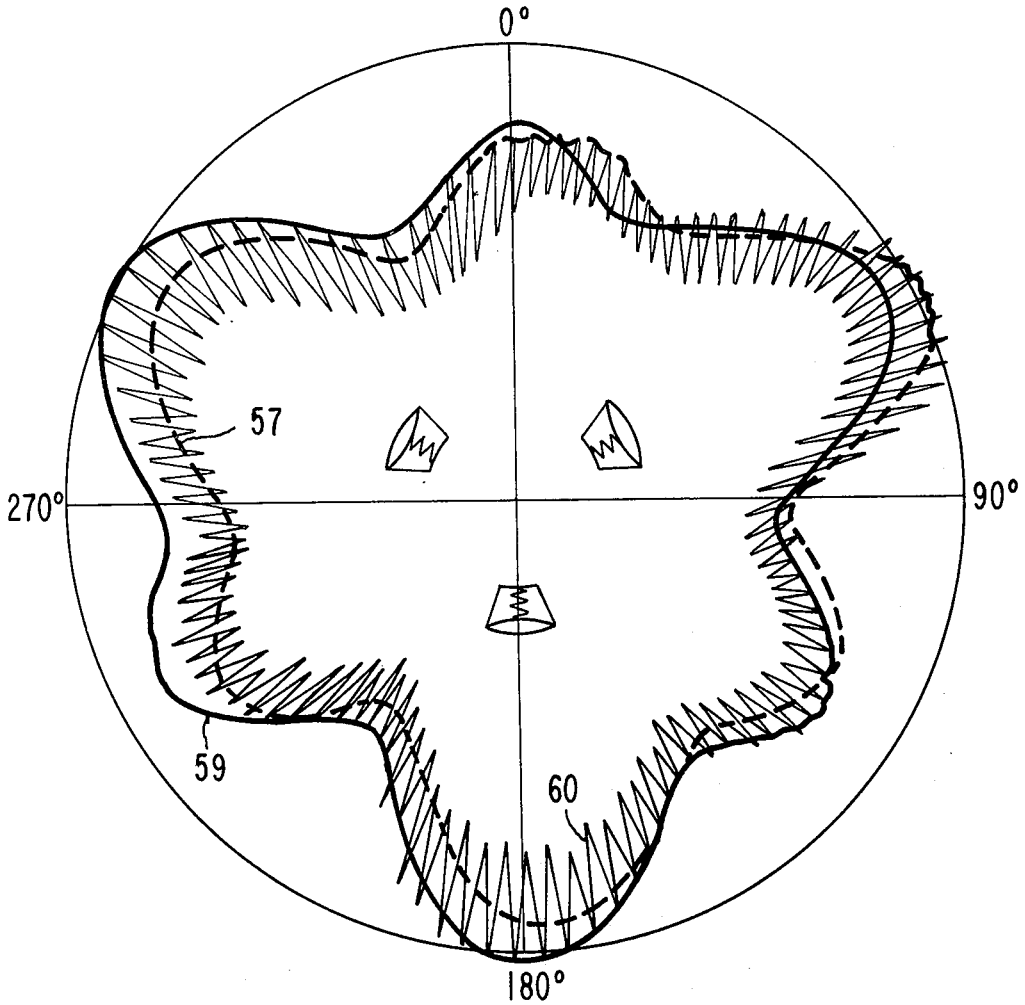
FIG. 5 is a horizontal pattern of three of the helical antennas of FIG. 1 mounted to a triangular tower as illustrated in FIG. 4.

FIG. 5 illustrates the horizontal pattern of the antennas as illustrated in FIG. 1 mounted as illustrated in FIG. 4. The horizontal pattern is represented by the pattern defined by dashed lines 57 and the vertical polarization pattern is defined by a solid line 59. As can be seen viewing FIG. 5, they approximate each other. The serrated horizontal pattern 60 illustrates the axial ratio of this particular antenna when measured by a test set up as described by Dr. Ben-Dov in IEEE Transactions on Broadcasting, March 1972, entitled "Measurement of Circularly Polarized Broadcast Antennas." The minimum to maximum ratio of the serrated pattern at any azimuth angle is the axial ratio in that direction. This axial ratio is on the order of 2.5 db or less. It can be seen that a satisfactory omnidirectional pattern with low axial ratios is provided by this structure.

What is claimed is:

1. An end-fire helical antenna comprising:

a funnel-shaped, electrically conductive reflector having a base at one end and tapering sides to a larger aperture at the opposite end, a helical coil extending in an axial direction from a fixed point near the base of the reflector to the plane of the aperture, said helical coil having a given diameter and pitch such that one turn equals approximately one wavelength at an operating frequency of said antenna, a flat conductive plate connected to the aperture end of said helical coil, and means for conductively mounting said flat plate to said funnel-shaped reflector.

2. The combination claimed in claim 1 wherein said flat plate is electrically connected to said helical coil at the extreme aperture end of the helical coil and at points along the coil approximately a quarter wavelength, a half wavelength and three quarters of a wavelength from said extreme end of said helical coil.

3. The combination claimed in claim 2 wherein each of said points along said coil are connected to different points on said flat plate that are substantially equally spaced from each other near the periphery of said flat plate.

4. The combination claimed in claim 1 wherein said means for conductively mounting includes a post of conductive material that is connected between the center of said base and the center of said flat plate.

5. The combination claimed in claim 1 wherein said coil is two wavelengths long with an axial length of about 0.22 wavelengths.

6. The combination claimed in claim 5 wherein said base is flat and the diameter of said flat base of said reflector is 0.4 wavelengths and the diameter of said aperture of said reflector is 0.58 wavelengths.

7. The combination claimed in claim 6 wherein said flat plate is a circular disk.

8. The combination claimed in claim 7 wherein the diameter of said disk is 0.23 wavelengths.

9. The combination claimed in claim 1 wherein the pitch of said helical coil is about 8°.

* * * * *